United States Patent [19]

Poetschke et al.

[11] 4,401,437

[45] Aug. 30, 1983

[54] APPARATUS FOR MANUFACTURING AND STABILIZING COAL-OIL-WATER FUEL MIXTURE

[75] Inventors: Leonard E. Poetschke, Chester Basin, Canada; Vernon Zeitz, Springfield, Vt.

[73] Assignee: Scotia Recovery Systems Limited, Halifax, Canada

[21] Appl. No.: 334,539

[22] Filed: Dec. 28, 1981

Related U.S. Application Data

[63] Continuation-in-part of Ser. No. 249,918, Apr. 1, 1981.

[51] Int. Cl.[3] ..... C10L 11/08; C10L 1/32

[52] U.S. Cl. ..... 44/2; 44/51; 261/DIG. 48

[58] Field of Search ..... 44/2, 1 SR, 51; 261/DIG. 48

[56] References Cited

U.S. PATENT DOCUMENTS

| | | | |
|---|---|---|---|
| 3,017,342 | 1/1962 | Bulat et al. | 208/11 LE |
| 4,151,067 | 4/1979 | Grow | 208/11 LE |
| 4,152,120 | 5/1979 | Zavitsanos et al. | 44/1 SR |
| 4,156,593 | 5/1979 | Tarpley, Jr. | 44/1 SR |
| 4,326,855 | 4/1982 | Cottell | 44/51 |

FOREIGN PATENT DOCUMENTS

| | | | |
|---|---|---|---|
| 350361 | 5/1935 | Canada . | |
| 350528 | 5/1935 | Canada . | |
| 2038651 | 7/1980 | United Kingdom | 261/DIG. 48 |

*Primary Examiner*—Carl F. Dees

[57] ABSTRACT

Apparatus suitable for making a coal-oil-water fuel mixture includes a grinder for grinding coal to a relatively fine particle size, a mixer for controllably mixing the coal particles with water and oil and a sonic agitator to stabilize the mixture. The sonic agitator comprises a processing chamber associated with or having two opposed plates which are oscillated by appropriate transducers at controllable phase frequency and amplitude. The spacing between the plates is preferably of the order of 500 meters per second divided by the applied sonic frequency, and is at least 25 mm.

34 Claims, 11 Drawing Figures

FREQUENCY SELECTOR

PHASE CONTROL
102

POWER CONTROL

POWER DRIVER

APPARATUS FOR MANUFACTURING AND STABILIZING COAL-OIL-WATER FUEL MIXTURE

U.S. patent application Ser. No. 249,918, filed on Apr. 1, 1981 in the names of Zeitz and Poetschke and of which this application is a continuation-in-part, describes a preferred coal-oil-water fuel, for the manufacture of which the present invention is suitable.

FIELD OF THE INVENTION

The present invention relates to an improved apparatus for making coal-oil-water fuel mixtures.

RELATED APPLICATIONS

The preferred ultrasonics processing apparatus for use in implementation of the process of this invention is the subject of U.S. patent application Ser. No. 275,988, filed on June 22, 1981 in the name of Zeitz.

DESCRIPTION OF PRIOR ART

As is well known, the energy required by the present industrialized societies is largely obtained from the combustion of fossil fuels, particularly liquid fuels derived from petroleum. Recent substantial increases in the price of petroleum, the prospect of further such increases and actual or threatened shortages of petroleum, have led to increasing interest in alternative fuels, derived in whole or in part from sources other than liquid petroleum. Many industrialized countries, including Canada, still have substantial reserves of available coil, but the use of coal in solid form, as an alternative fuel, is attended by many problems, not least of which is the fact that much existing physical plant is designed to use liquid fuel.

One approach to this problem, is to utilize a composite fuel, comprising a mixture of oil and coal, or a mixture of oil, coal and water, in order to reduce the quantity of petroleum-derived fuel which must be consumed to produce a given quantity of energy. At the present time, such composite fuels are contemplated primarily as substitutes for heavy industrial fuel oils, such as are consumed in thermal electric generating plants, but it is, of course, possible that coal-containing liquid fuels may find wider applications in the future.

Since coal is not soluble in fuel oil or water, composite fuels of the type contemplated, are in the nature of mechanical mixtures of finely divided coal in oil or in a water-oil emulsion. A principal problem associated with such composite fuels is lack of stability; i.e. the tendency of the coal component to settle out of the mixture during storage and handling.

There are presently at least three basic methods known for dealing with the problem.

One method is the continuous agitation of finely ground coal particles with oil or oil and water. This method requires the use of expensive equipment and involves a high power consumption. A further problem is that the stirring equipment may fail, for example as a consequence of a power failure, resulting in the coal particles settling out of the mixture.

A second method involves the ultra-fine grinding of coal. In this method, coal particles are ground to an average size between 1 and 3 microns, as compared with the more usual average size of between 25 and 40 microns. By grinding coal particles to the smaller sizes, a greater surface area is obtained which allows for greater bonding of the oil and water with the coal particles. However, grinding the coal to this smaller size substantially increases the power requirement for the grinding process, which increases approximately exponentially as the desired particle size decreases.

A third method is the use of stearates to create chemical stabilization of the coal-oil-water mixture. Although the use of stearates does not produce a mixture having satisfactory stability, stearates are expensive and the quantity of stearates required to achieve satisfactory stability makes this method prohibitively expensive.

Various ultrasonic and sonic processing devices for the treatment of materials (usually a medium in the liquid phase) are well known. Generally, they can be characterized as either static (or batch) processors or continuous, flow-through processors. Such processors can produce within a medium oscillations over a predetermined range of frequencies, which oscillations are used generally for the purposes of emulsification, solubilizing and cleaning.

Static processors usually comprise a processing chamber for containing a material to be treated and at least one plate or other member (transducer) for contacting this processing chamber or material and for being ociallated at a predetermined frequency, usually in the ultrasonic range.

Continuous, flow-through processors known in the prior art generally comprise a processing chamber through which the material to be processed flows or circulates and at least one transducer for contacting the processing chamber or flowing material and for being oscillated at a predetermined frequency.

However, such prior ultrasonic processors are limited in size and not suitable for use with materials comprising liquid having large solid particulates therein such as, for example, a "slurry" of coal particles mixed with water and oil. Thus, prior ultrasonic processors are unavailable for either high volume processing or for efficient use, except at high expense. One reason for such unsuitability of prior art devices is their inability or limited ability to provide large ultrasonic processing chambers. This limitation is a result of the inherent limitations of prior ultrasonic processors with respect to the manner in which they act upon materials to produce the desired effects.

Sonic or ultrasonic processing involves the application of a cavitation process. The term "cavitation" is used to denote a process for the formation of local cavities in a liquid as a result of the reduction of total pressure. Although other means for creating cavitation are possible, the current preferred method for effecting the cavitation process is by the use of sonics or ultrasonics. (The term "ultrasonics" is commonly used to refer to such processes, even if the frequencies employed fall within the audio range, i.e. are strictly speaking "sonic" rather than "ultrasonic". In the following discussion the terms "sonic" and "ultrasonic" are used interchangeably and either term is to be understood as including the use of ultrasonic as well as sonic frequencies).

It is known that the achievement of the desired results by ultrasonic processors is not a gradual process but rather a threshold effect. That is, until a certain power intensity or threshold of ultrasonic oscillations is reached, the desired result is not achieved. The amplitude or intensity at which this effect occurs is called the "threshold level". Increasing the amplitude or intensity of sonic energy substantially above the threshold level does not usually enchance the results to any great degree.

In practice, threshold levels may be fairly easily utilized and achieved in static processors since the cavitation effects, characterized by tremendous differential pressures, can occur within all areas of the material to be processed within two to three inches of the transducer surface in a matter of seconds.

The achievement of threshold effects in continuous flow-through processors is not so easily accomplished in view of the obvious time factor causing the material to be exposed to the ultrasonic oscillations for only a limited period of time (determined by the rate of flow). In continuous flow processing it is necessary to cause the cavitational effects to impinge upon all required sites within the material being processed while insuring that the threshold effect power level is applied to these sites rapidly to enable as high a flow rate as possible.

Certain types of continuous flow processing apparatus are known in the prior art which minimize this time factor by creating a very small processing volume. Others attempt to concentrate relatively high intensities in a small working space. Ultrasonic processors for use in coal-oil-water fuel manufacturing processes have been used for cleaning the coal. To this end, ultrasonic energy has been applied to the coal-oil-water slurry by means of a small-diameter cylindrical probe immersed in the flow-path of the slurry (see e.g. Cottell U.S. Pat. No. 3,941,552 issued Mar. 2, 1976). While a large ultrasonic energy intensity is achievable within the immediate vicinity of the probe, the cavitation effect is less pronounced as one moves away from the probe. Furthermore, the exposure time during which the slurry is exposed to ultrasonic energy is very abbreviated, given the inefficient shape of the probe. This means that the slurry tends not to be uniformly treated.

Another ultrasonic continuous flow processing apparatus (not used for producing coal-oil-water mixtures) of the type having small processing volume is characterized by a large surface area in contact with oscillating plates which are separated by an extremely small distance in the order of 0.1 to about 25 millimeters. An example of one such prior art device is shown in U.S. Pat. No. 4,071,225 dated Jan. 31, 1978. Such prior continuous flow processors are obviously less efficient than larger ones and are unsuitable for the processing of large volumes of coal-oil-water mixtures.

Furthermore, prior ultrasonic processing devices typically do not incorporate means to vary the frequency, amplitude and/or phase of oscillations produced in oscillating members. While prior art processors such as that disclosed in the aforementioned U.S. Pat. No. 4,071,225 are known to mix frequencies of transducers within one ultrasonic processing device, each transducer used in such devices is fixed to oscillate only at one predetermined frequency and with no synchronization or variation of phase or amplitude possible among the various transducers.

Research into the nature and properties of coal-oil-water mixtures has led to the conclusion that the stability of the mixture produced is largely dependent upon water bonding between coal particles, from which it follows that the molecular tension or surface tension of the water bonding between the solid coal particles is a significant factor affecting the stability of the coal-oil-water mixture. It has also been concluded that the hydrophobic nature of both coal and oil is another factor affecting the stability of the coal-oil-water mixture. When a mixture of relatively porous coal particles and water is agitated, water is driven into the cavities in the coal particles. When oil is added to the coal-water mixture, spherical coal-oil-water agglomerates are formed. Since both coal and oil are hydrophobic, areas of the surface of the coal particles tend to be attracted to the oil. A mixture of coal-oil-water spherical agglomerates is not a particularly stable suspension but when energy is added to the mixture (such as, for example, by high speed stirring or by homogenization) the coal-oil-water agglomerates are broken down. The mixture is thus rearranged into a relatively stable lattice-like structure wherein water bridgings between adjacent coal particles and coal-oil bridgings maintain the coal particles in suspension.

It has been found that a structured, relatively stable coal-oil-water mixture for use as a fuel can be produced by grinding coal to a relatively fine particle size, mixing water with the coal particles to drive water into the pores of the coal particles, adding a suitable high molecular weight organic compound and adding sonic or ultrasonic energy to promote water bridging between porous portions of the coal particles. The foregoing steps may be performed simultaneously. The high molecular weight organic compound, being hydrophobic, tends to promote bridging between the hydrophobic portions of the surfaces of the coal particles. Heavy residual oils containing paraffinic fractions (such as, for example, number 6 oil) are a preferred source of suitable high molecular weight compounds since they are relatively inexpensive.

In producing a structured, relatively stable coal-oil-water mixture for use as a fuel, additional steps are preferably performed to reduce the ash content of the final fuel mixture. As indicated previously, coal is ground to a relatively fine particle size and mixed with water. Distillate oil (e.g., number 2 oil) is then added to promote the formation of coal-oil-water spherical agglomerates which are then separated from the excess water and much of the ash. As before, a high molecular weight organic compound is added, such as low molecular weight polyethylene or polystyrene which may be used in place of, or in conjunction with, the distillate oil. As before, ultrasonic energy is added to the mixture to promote water bridging between porous portions of the coal particles. The addition of ultrasonic energy results in the rearrangement of the coal-oil-water spherical agglomerates into a lattice-like structure wherein the coal particles are held in a stable suspension by hydrophilic bridgings (between water molecules) and hydrophobic bridgings (between surfaces of the coal particles by the suitable high molecular weight organic compound).

This process is currently the best available known means for producing a relatively stable coal-oil-water mixture. In addition, the coal-oil-water suspension produced by the use of ultrasonics is relatively stable at elevated temperatures. For example, at a temperature of about 150° F., little or no settling out of coal particles has been observed. The suspension produced is also relatively stable over time. The major disadvantage associated with this method is the expensive involved in providing equipment to cavitate a coal-oil-water mixture by means of ultrasonics.

Typically coal is ground to a relatively fine particle size. The coal particles are mixed with water and a high molecular weight organic compound. A sonic agitator is used to stabilize the mixture. (The grinder, mixer and sonic agitator may be combined as a single unit.) Mixtures having paraffinic fractions such as, for example, residual oils are suitable sources of suitable high molecular weight organic compounds.

The grinder may be one that grinds coal to a relatively coarse particle size or one that grinds coal to a relatively fine particle size. In the former instance, the coarse grinder could be a hammer mill. The coal particles could then be mixed with water and cleaned (e.g. by froth flotation or heavy media separation). The cleaned mixture could then be ground to a relatively fine particle size by means of an attrition mill or the like. In the latter instance, the relatively fine coal particles could be mixed with water and cleaned by sonic agitation, froth flotation or other suitable processes.

Unfortunately, previous conventional ultrasonics processing apparatus is unsuitable to achieve the foregoing objectives in the most efficient and economic manner. It appears to have been assumed that high intensity energy devices would have to be used, in order to cavitate the mixture sufficiently as the slurry passes the probe. But provision of an energy intensity above a suitable threshold is of little or no value; furthermore, the short exposure time of any given volume of slurry to the ultrasonics energy applied militates against uniform cavitation of the mixture.

SUMMARY OF THE INVENTION

Apparatus according to the invention for manufacturing a coal-oil-water mixture for use as a fuel comprises (a) a grinder for grinding coal to a relatively fine particle size;

(b) mixing means for controllably mixing said coal particles with water and oil; and (c) a sonic agitator to stabilize the coal-oil-water mixture.

The grinder and mixing means may be in accordance with appparatus devised by the inventors and described further below. The sonic agitator is preferably that described in the above-mentioned patent application Ser. No. 275,988.

Particularly, it has been found that disadvantages associated with prior ultrasonics processors can be overcome in the treatment of coal-oil-water slurries by applying relatively low intensity ultrasonics energy to the mixture over a relatively long exposure time, as compared to the conventional technique using an ultrasonics probe. This is accomplished according to the present invention by providing, as two sides of a processing chamber, opposed, spaced parallel plates oscillated by transducers at a desired frequency. The plates can be as long and as wide as desired; the spacing however between the plates must be consistent with the operating frequency chosen. (As a general rule of thumb, the spacing should be inversely proportional to frequency, and preferably greater than 25 mm. A spacing equal to 500 meters per second divided by the frequency has been found suitable). The length and width of the plates should be selected, for any given plate spacing and slurry flow rate, to meet both production requirements and cavitation exposure requirements. Specifically, it has been found that an ultrasonics energy intensity of a fraction of a watt per square centimeter up to about 4 or 5 watts per square centimeter, at a frequency within the audible range to humans (with plate spacing selected accordingly, e.g. approximately 5 cm. at about 10 KHz) is satisfactory for adequate cavitation of coal-oil-water slurries of the type used for fuels (which typically comprise 50–70% coal particles, about one third oil, and the balance water), provided that the length and width of the plates is sufficiently large to provide a useful dwell or exposure time of the slurry within the energization chamber. The dwell time should be at least about half a second and is preferably about 3 to 15 seconds, although in some cases longer exposures may be beneficial.

Suitable hydrophilic thickening or gelling agents may be added in small quantities to the coal-oil-water mixture to improve flow characteristics and stability of the emulsion. The present invention is not however per se directed to the use of such agents. For further information, the reader is referred to U.S. patent application Ser. No. 249,918, filed on Apr. 1, 1981, in the names of Zeitz and Poetschke, entitled "LIQUID COAL MIXTURE AND PROCESS FOR MANUFACTURING SAME".

DETAILED DESCRIPTION

Figure 1:
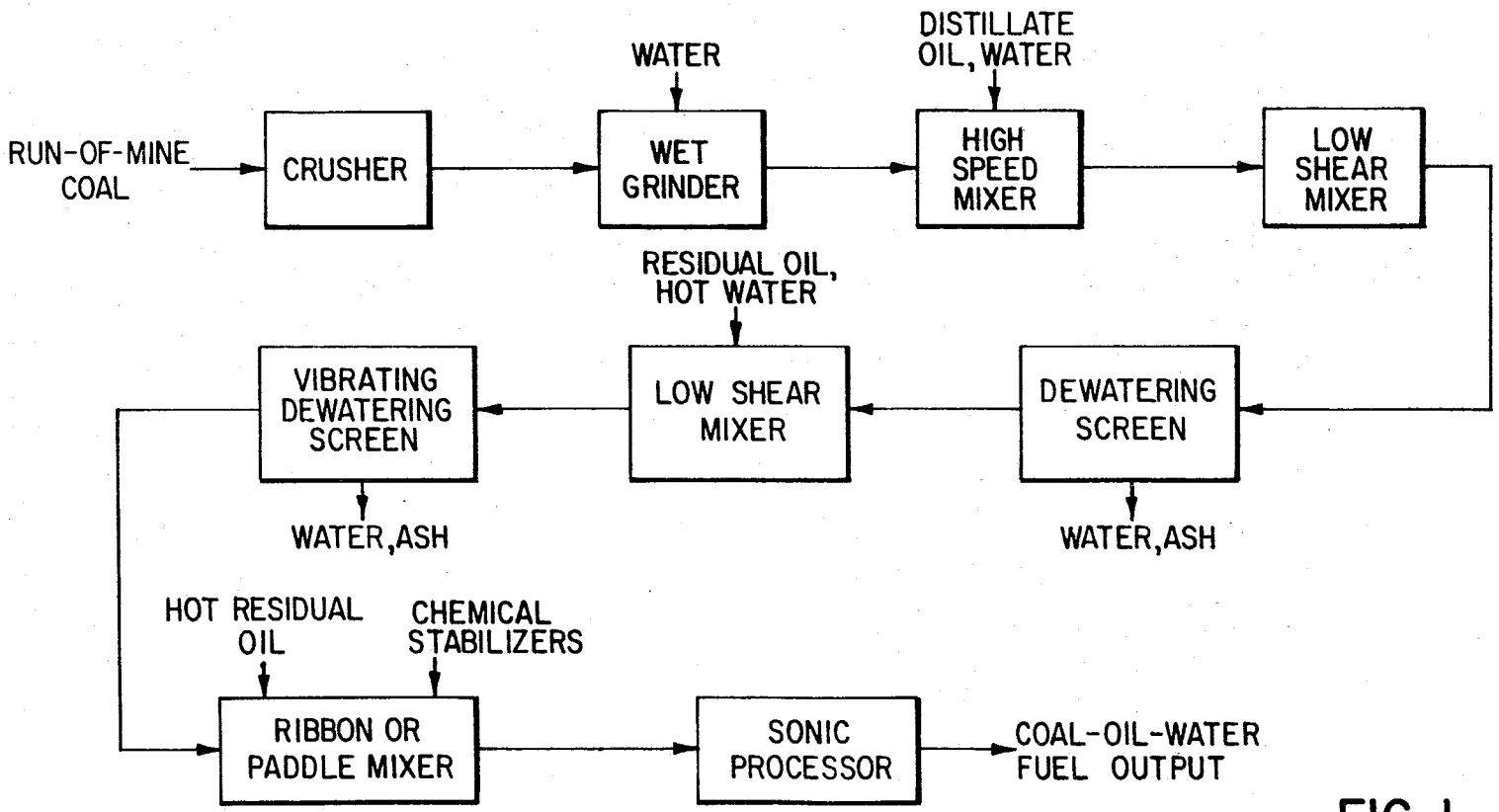
FIG. 1 is a block diagram illustrating apparatus according to the invention for manufacturing coal-oil-water fuel.

In the processing apparatus as shown in FIG. 1 run of mine coal (ROM) containing from 5% to 27% ash components, including from 0.5% to 3.0% sulfur distributed as organic sulfur and pyrites, is introduced to a crusher which reduces the size of the coal to minus ½ inch. The crusher may be a cone crusher, gyratory crusher or jaw crusher. The minus ½ inch coal is then introduced into a wet grinding mill along with water where the particle size is reduced to 85% minus 200 mesh. The mill may be any one of a number of suitable wet grinding mills such as a horizontal rotating pin mill. A large hammer mill or ball mill could also be employed for this purpose. The mill discharge which is an aqueous slurry of coal and ash components is then diluted with water, a petroleum distillate oil added and the mixture passed through a high speed or high shear mixing device in which the mixture is violently agitated and passed onto a low shear mixer. The combined high shear-low shear mixers allows the formation of spherical coal-oil-water agglomerates which separate from the ash and inorganic minerals which remain suspended in the aqueous phase. The coal-oil-water agglomerates are then physically separated from ash-containing water using a slotted screen. The agglomerated coal slides off the top of the screen while the ash-water components pass through the screen whereby the ash and pyrites can be removed in a clarifier or settling lagoons.

The agglomerates collected from the top of the watering screen typically have a composition of coal-oil-water, as follows:

coal—65%-75%-w/w
oil—5%-15%-w/w
water—20%-30%-w/w

The agglomerates are then resuspended in hot water, residual oil is added and the mixture agitated using a second low shear mixer stage. The agglomerates found in the stage characteristically have a lower water content after dewatering on a vibratory screen (such screens suitable to this use are manufactured by Sweco Corp.).

The dewatered agglomerates are then passed to a paddle mixer or ribbon blender where hot residual oil is added to bring the composition of the mix to about:

coal—55%-w/w
oil—33%-w/w
water—12%-w/w

Additional chemical stabilizers such as Separans or Methocells may be added to the ribbon mixer along with the second stage agglomerates for blending prior to sonic stabilization. These chemicals are added using a precision liquid metering system such as manufactured by Milton-Ray Cor. or Ivek Cor. Further information concerning the use of chemical stabilizers is to be found in copending U.S. patent application Ser. No. 249,918, filed in the names of Zeitz and Poetschke on Apr. 1, 1981.

The resulting mixture is then passed through a sonic processor preferably that known as the "Ultraprocessor" and manufactured by Minerals Separation Corp. This processor is described further below. The resulting fuel is stabilized and capable of being stored without unacceptable settling for periods in excess of six months.

Alternative procedures may be substituted prior to the agglomeration steps. For example, the coal may be ground dry using a Raymond Mill or ball mill. The dry powdered coal may be then slurried with water and added to the agglomeration process for cleaning. Alternatively the slurry may be first cleaned using froth floatation. The froth concentrate may be then passed to the agglomeration process for further cleaning and dewatering. Those skilled in the art recognize that a myriad of possibilities exist with respect to alternative grinding and cleaning procedures which may be substituted prior to the agglomeration and stabilization steps in manufacturing the fuel.

As mentioned above, it has been found that a parallel-plate sonic cavitation device such as that described below with reference to FIGS. 2 to 10 is particularly suitable for breaking down the coal-oil-water agglomerates to form the final lattice-like structure. A preferred sonic cavitation device is a sonic parallel plate device sold by Minerals Separation Corporation under the trade mark ULTRA-PROCESSOR. The Minerals Separation device is particularly useful for high volume processing since relatively large opposed transducer plates are used. Thus, only a relatively low power intensity at any given point is required; typically less than 4 watts per square centimeter and as low as 0.8 watts per square centimeter. It is expected that with many coal-oil-water slurries the preferred power requirement range will be found to be below 2 watts per square centimeter, and that power levels appreciably above this figure may tend to destabilize the fuel mixture. Although the overall power requirement of such a device would be greater than the sonic probe type units, the use of the opposed transducer plates allows for a relatively long dwell time with a greater effective field penetration. Furthermore, the lower the operating frequency of the Minerals Separation device, the wider the gap between the transducer plates can be. Although such a device can be operated as an ultrasonic device, its preferred use with the present method would be as a sonic device in the frequency range at about or below 10,000 Hz. In fact, it is expected that the Minerals Separation device can be adapted for use with the present method whereby the device will operate in the range of 3,000 to 4,000 Hz. Thus, the gap between the transducer plates can be significantly increased, thereby allowing for a greater volume of mixture to be processed at any given time.

The final fuel mixtures manufactured using the present invention are suitable for use as substitute fuels in, for example, installations presently using heavy industrial oils. The fuel mixtures of the present invention, when at rest, exhibit relatively high viscosity. However, the mixtures have significant thixotropic properties, and it has been found that, under pressure, they are sufficiently fluid to be pumped and atomized by suitable pumps and jets, not different in principle from those conventionally used in heavy-oil buring installations. Some modification of these devices will probably be desirable to permit effective utilization of these fuel mixtures.

As already mentioned, the use of a suitable parallel-plate ultrasonics processor greatly facilitates the processing of coal-oil-water slurry because it can efficiently generate the low-energy-intensity long-dwell-time cavitation required for the practice of the present invention. The processor of FIGS. 2–11 has been found particularly suitable and will now be described in detail. It is the subject of a separate U.S. patent application Ser. No. 275,988 filed on June 22, 1981, in the name of Zeitz.

Figure 2:
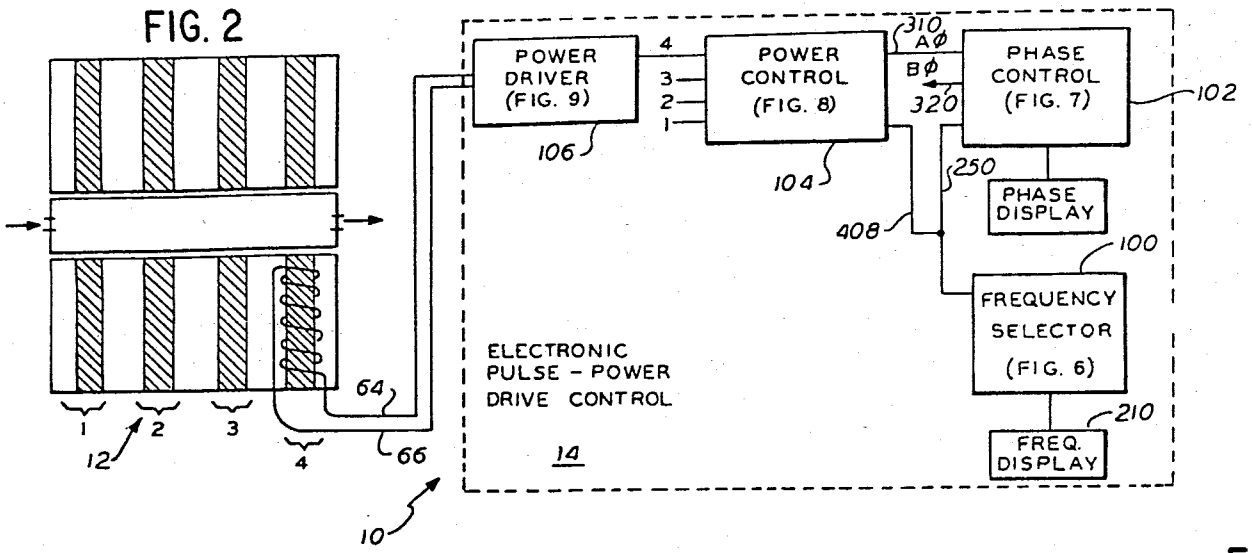
FIG. 2 is a side elevational, cross-sectional diagrammatic view of the preferred embodiment of the processing unit and circuitry of a sonics processing unit suitable for use in the practice of the invention.

The processing apparatus is shown in FIG. 2 as a system and is generally designated by the numeral 10 having a processing unit 12 and an electronic pulse-power drive control unit 14.

Figure 3:
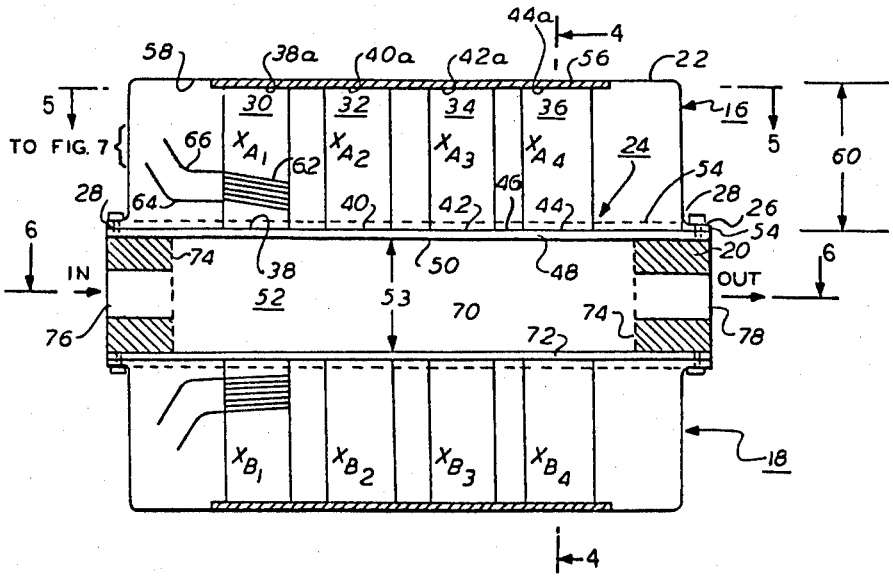
FIG. 3 is a more detailed side elevational, cross-sectional view of the processing unit shown in FIG. 2.

Processing unit 12, more specifically shown in an elevational cross-section view in FIG. 3 comprises a top unit "A" generally designated by numeral 16, a bottom unit "B" generally designated by numeral 18 and a spacer 20 interposed therebetween. Top unit 16 is, in the preferred embodiment, identical to bottom unit 18 and, therefore, only elements within unit 16 will be discussed in detail herein, it being understood that the preferred embodiment incorporates both units 16 and 18.

Figure 4:
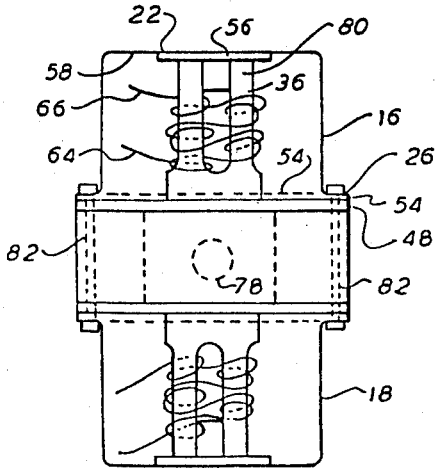
FIG. 4 is a front elevational, cross-sectional view of the processing unit of FIG. 2 taken along the lines 4—4 of FIG. 3.

Unit 16, best seen in FIGS. 3 and 4, includes housing 22 in the form of a rectangular parallelepiped enclosed on 5 sides and open at side 24. Housing 22 may be of a one-piece molded or stamped construction utilizing metal or some other suitable material. Housing 22 is provided with a peripheral flange 26 having a plurality of apertures 28 therein for receiving bolts for securing housing 22 to spacer 20 and unit 18, as will be more fully apparent below.

Housing 22 is for encasing a plurality of transducers (herein designated) 30, 32, 34 and 36 therein. These transducers 30, 32, 34 and 36 will sometimes hereinafter be referred to as $X_A$ transducers indicating their position within top unit "A" as opposed to $X_B$ transducers which are those within bottom unit "B". The $X_A$ transducers 30, 32, 34 and 36 are all identical in the preferred embodiment to each and to the XB transducer and are more clearly seen in FIGS. 4 and 5. These transducers 30, 32, 34 and 36 are, in the preferred embodiment, magnetostrictive ferrite transducers made from ceramic type material such as oxides of iron such as zinc and manganese or other suitable magnetostrictive materials such as iron, nickel, cobolt or they alloys. Their radiating surfaces are at 38, 40, 42 and 44 respectively. All transducers disclosed herein are driven or caused to oscillate within a predetermined frequency range in a predetermined manner by electronic pulse-power drive-contral unit 14 as will be more fully explained below. The frequency range of the preferred embodiment is 1 to 99,900 Hz, however, while the frequency is adjustable within this range (as will be explained below), any one set of $X_A$ and $X_B$ transducers may only be frequency variable within a portion of this range (for example, 20 $kH_2$). Thus, the range of frequency variations which may be produced by the preferred embodiment is dependent upon the transducers chosen and if a greatly different frequency is desired the set of $X_A$ and $X_B$ transducers should be installed.

Each radiating surface 38, 40, 42 and 44 is bonded by a suitable bonding material to the back 46 of vibrating plate or diagraph 48 of unit A (sometimes hereinafter referred to as plate "A"). Those skilled in the art will realize that if a bonding material is used to secure the radiating surfaces of the transducers to back 46 it must be compatible with the material of the $X_A$ transducers and of plate 48 and must be able to transmit the oscillations of each transducers' radiating surface to plate 48 without significant degradation. The plate 48 and the transducer 30, 32, 34 and 36 should have similar and compatible coefficients of expansion.

Plate 48 has a working surface 50 which may be of a coating material other than that of plate 48. Surface 50 should be an abrasion and corrosion resistant material capable of withstanding the highly abrasive environment within processing chamber 52 to which it (surface 50) will be subjected, such as non-magnetic stainless steel, nickel, titanium, tantalum or aluminum oxide. Plate 48 is the same size as flange 26 and is provided with apertures in alignment with apertures 28. A spacer 54 is interposed between flange 26 and the back 46 of plate 48 in order to insulate housing 22 from the oscillations of plate 48.

In any event, plate 48 should be as thin as possible in order to increase the efficiency of power transfer to the material flowing through processing chamber 52.

The ends of all $X_A$ transducers 38*a*, 40*a*, 42*a* and 44*a* opposite radiating surfaces 38, 40, 42 and 44 respectively, are bonded to a backing plate 56 which is, in operation, abutted against the inside surface 58 of housing 22. Consequently, those skilled in the art will realize plate 56 must be of a vibration insulating material so as to avoid needless and inefficient transfer of energy to housing 22 and away from working surface 50. The depth 60 of housing 22 is equal to the combination of the thickness of plate 56 and the length of a $X_A$ transducer in order to effect a tight fit between all components when unit 16 is assembled.

Those skilled in the art will realize that the apparatus disclosed herein will function properly without housing 22 and backing plate 56. If the transducers are brazed or otherwise suitably bonded to the oscillating plates then there is no need for the housing and plate.

Figure 6:
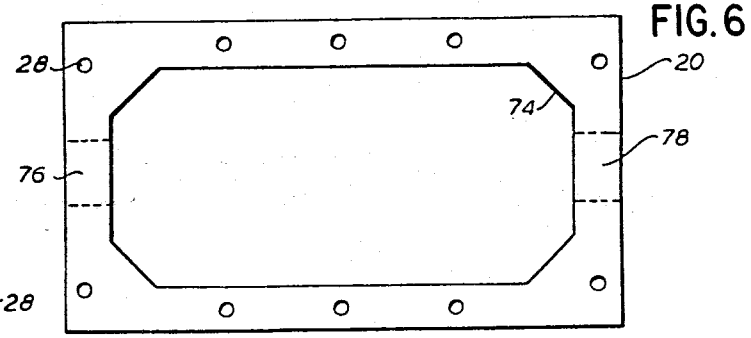
FIG. 6 is a plan view of the spacer of the processing unit of FIG. 4 taken along lines 6—6 of FIG. 3.
Figure 5:
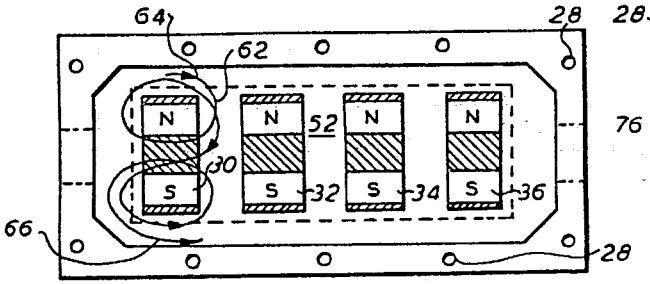
FIG. 5 is a plan view of the processing unit of FIG. 4 taken along lines 5—5 of FIG. 3.
Figure 7:
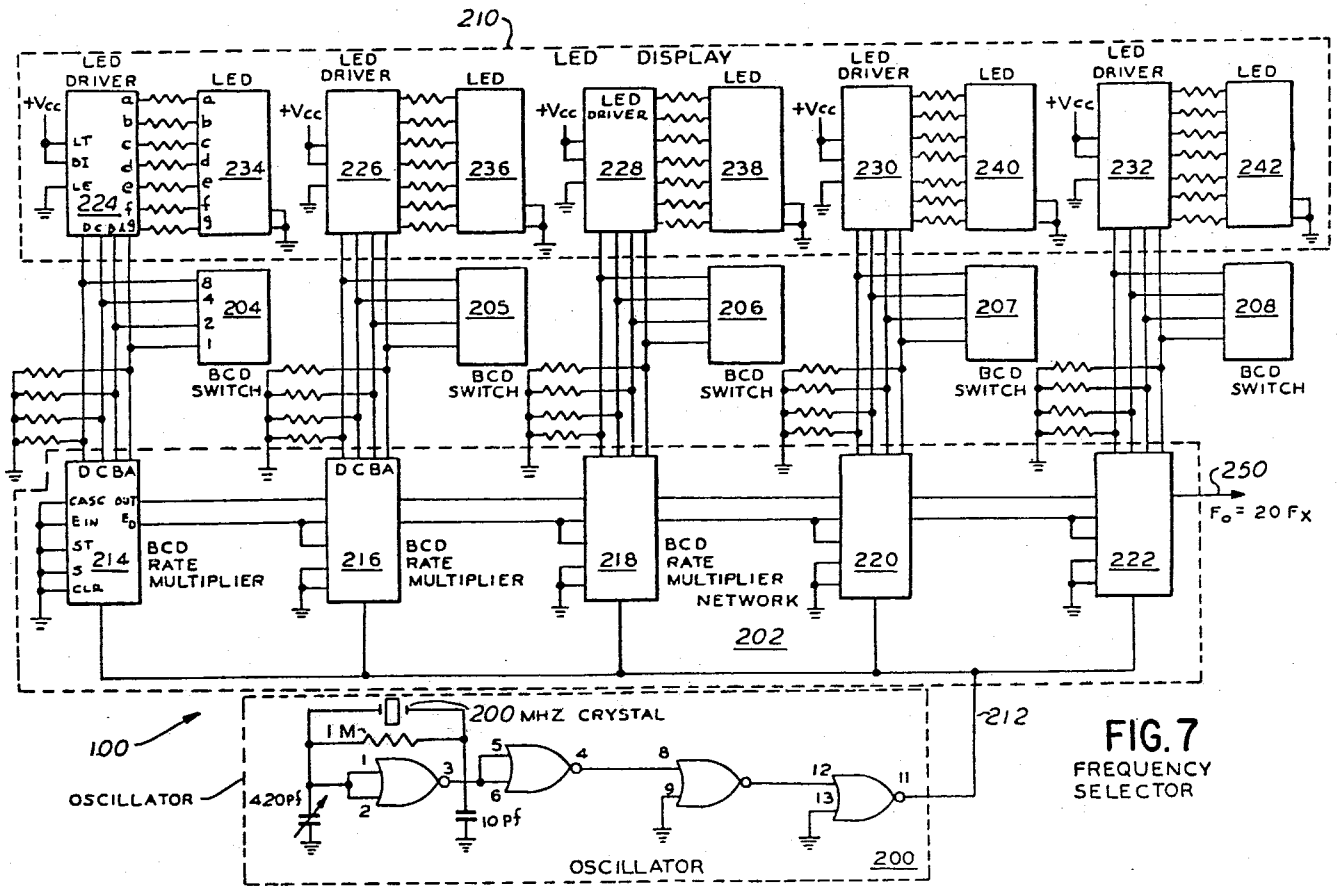
FIG. 7 is a schematic circuit diagram of the frequency selector portion of the processing unit of FIG. 2.

Each $X_A$ transducer is wound with a predetermined number of coils of suitable teflon coated wire 62 as shown schematically on transducer 30 in FIGS. 5 and 7 and transducer 36 in FIG. 6. Those skilled in the art will understand that the impedance of each transducer coil should be matched with the impedance of its driving circuit for efficient power transfer. (The windings are not shown on transducers 32, 34 and 36 in order to clarify the drawing.) All transducers are wound in parallel and each pair of ends 64 and 66 are connected to respective drive circuits as will be more apparent below with respect to FIG. 10. Wire 62 has end leads 64 and 66 which terminate at a point (not shown) external to housing 22. The means by which leads 64 and 66 pass through housing 22 is purely conventional and is not shown herein.

Processing unit 12 includes a processing chamber 52 formed by surface 50, the working surface 70 of the oscillating plate 72 of unit 18, and the interior surface 74 of the spacer 20. The shape of processing chamber 52 is more clearly seen in FIG. 5 which shows a plan view of spacer 20 including input port 76 and outlet port 78. Ports 76 and 78 may be threaded to be compatible with pipes (not shown) for feeding unprocessed material into chamber 52 and receiving processed material therefrom after it has been subjected to ultrasonic oscillations within chamber 52. Spacer 20 should be a material which will not absorb the ultrasonic energy within processing chamber 52. It should also be resistant to abrasion as well as chemically inert. For example, spacer 20 may be constructed from a non-metallic metal, plastic or elastomer.

The depth 53 of processing chamber 52 is obviously equal to the height of spacer 20. In operation of the preferred embodiment, spacer 20 may be either a single unit having the desired height or may comprise several layers of spacers having predetermined thicknesses which may be combined to produce the desired height. This height, and therefore depth 53, is a function of the power and frequency at which the transducers will be operated. Depth 53 may, for example vary from the order of 1 inch at 20 KHz to the order of 120 inches at 5 KHz. The greater the depth, the greater the power that must be applied to the oscillating plates.

FIG. 4 discloses a side elevational cross-section view of FIG. 3 taken along lines 4—4. FIG. 4 more clearly shows $X_Z$ transducer 36 and biasing magnet 80 associated therewith in a manner well known to those skilled in the art for producing a necessary bias to enable full and efficient utilization of magnetostrictive transducers. The biasing magnets shown need not be utilized if an electrical DC bias is applied to the transducers. Bolts 82 are also schematically shown in FIG. 6 indicating the means by which the various component elements of processing unit 12 are joined.

FIG. 5 is a plan cross-section view of FIG. 5 taken along line 5—5 and shows the shape of processing chamber 52, apertures 28, backing plate 56 and $X_Z$ transducers 30, 32, 34 and 36. Wire 62 and end leads 64 and 66 are diagrammatically shown wrapped around the N and S poles of transducer 30 in a pattern well known to those skilled in the art.

Figure 11:
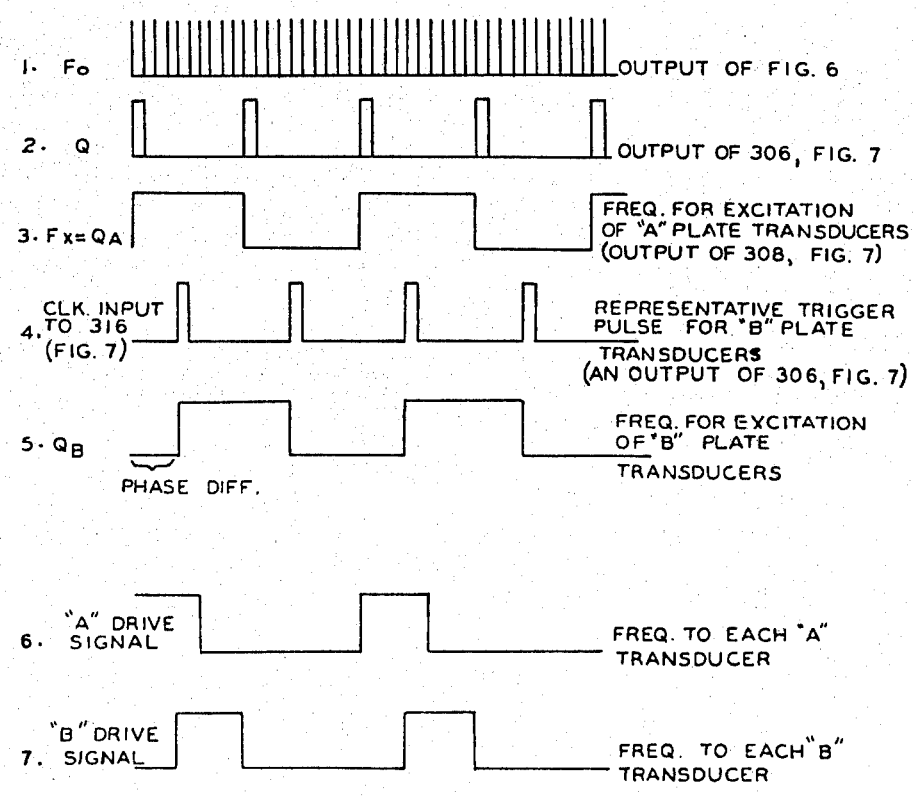
FIG. 11 is a schematic timing diagram showing various representative signals produced by the processing unit of FIG. 2.

Referring now to FIGS. 2 and 7 through 11, the operation of electrical pulse-power drive control 14 will be explained. As seen in FIG. 5, control 14 consists essentially of a frequency selector circuit 100, phase control circuit 102, power control circuit 104 and power driver circuit 106. Each of these circuits is more specifically described in FIGS. 7, 8, 9 and 10 respectively. FIG. 11 shows timing diagrams linking various circuit operations.

Referring now to FIG. 7, there is shown a schematic representation of frequency selector circuit 100 including 2000 MHz oscillator 200, binary coded decimal (BCD) rate multiplier network 202, BCD switches 204, 205, 206, 207, 208 and LED display section 210.

Oscillator 200 produces digital pulses at its output along line 212 to the rate multiplier network 202. Oscillator 200 may be of conventional construction, however, the design of oscillator 200 in the preferred embodiment employs an integrated circuit (for example, a 40001 Quad Nor Gate) wired as shown in FIG. 7.

Figure 9:
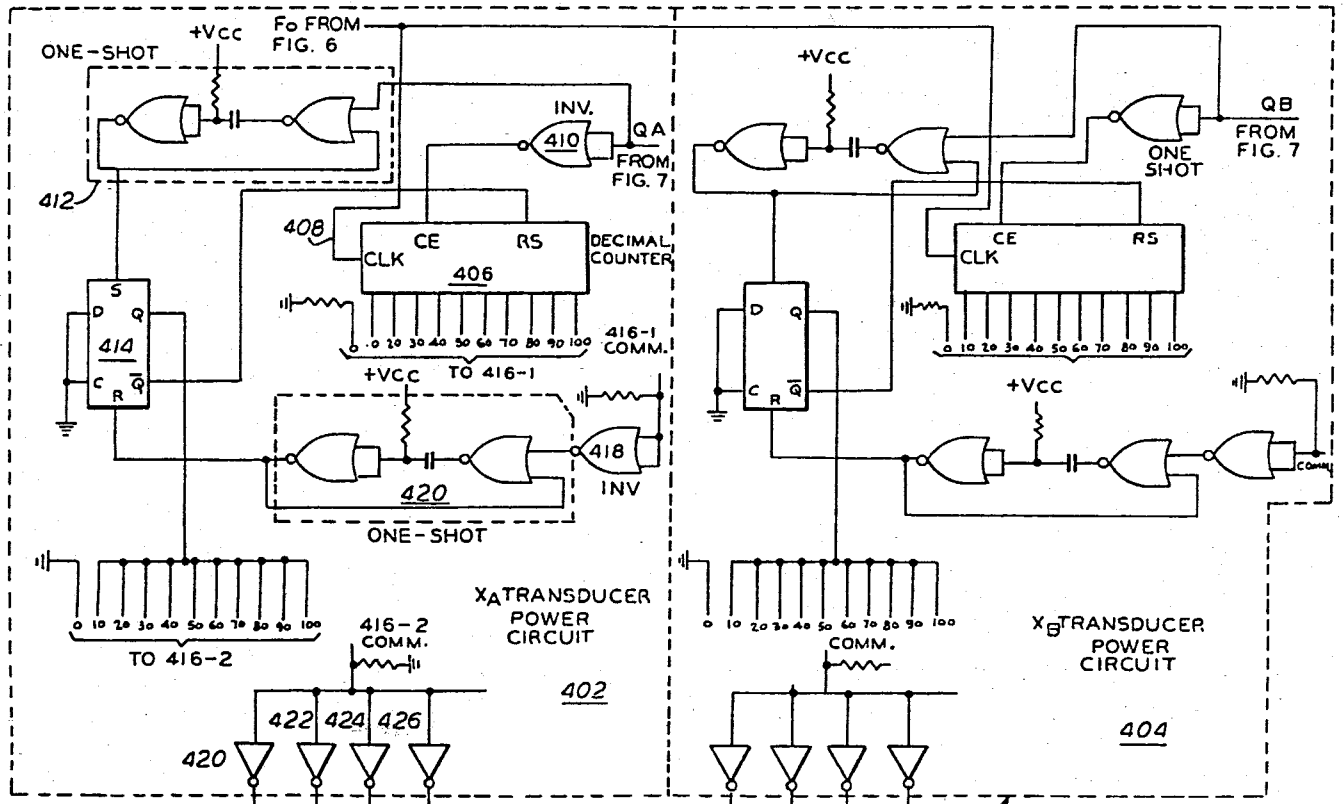
FIG. 9 is a schematic circuit diagram of the power control portion of the processing unit of FIG. 2.
Figure 10:
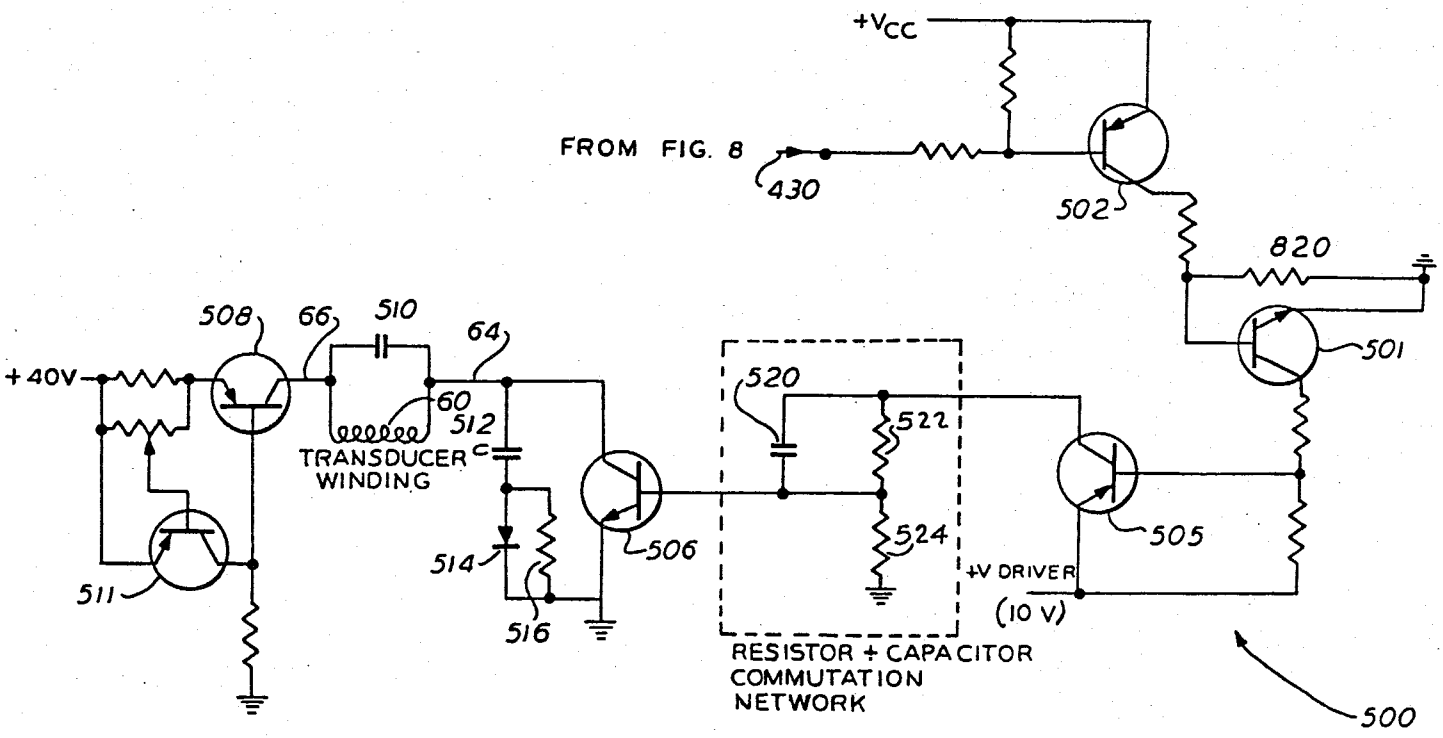
FIG. 10 is a schematic circuit diagram of the power drive portion of the processing unit of FIG. 2.

Rate multiplier network 202 comprises five cascaded integrated circuit chips 214, 216, 218, 220 and 222, each a 4527 BCD Rate Multiplier, all wired as shown in FIG. 9. Rate multiplier 214, 216, 218, 220 and 222 are each controlled respectively by BCD switches 204, 205, 206, 207 and 208. These BCD switches may, for example, be thumbwheel-type adjustable switches providing a BCD output from each switch as a function of the setting thereon. Switches 204, 205, 206, 207 and 208 are also respectively wired as shown with LED drivers 224, 226, 228, 230 and 232 which are themselves respectively wired to drive LED chips 234, 236, 240 and 242. The wiring of the various components of FIG. 4 is conventional and is therefore not discussed in detail herein.

Switches 204, 205, 206, 207 and 208 simultaneously provide a signal to their respective rate mutiplier and LED driver and, therefore, the output displays be LED display 210 is related to the output of rate multiplier network 202. As will be more fully explained below, the LED display section 210 will display, on chips 234, 236, 238, 240 and 242, the frequency $F_X$ ultimately provided to both $X_A$ and $X_B$ transducers. Simultaneously with this display, the output of the rate multiplier network 202 is herein designated $F_O$ on line 250 where, because of the cascaded design of network 202, $F_O=20\ F_X$. The necessity for providing a signal in the preferred embodiment at a multiple of $F_X$ is related to the ability of the apparatus disclosed herein to provide differential phrase oscillations between $X_A$ and $X_B$ transducers, as will be more fully explained below.

Figure 8:
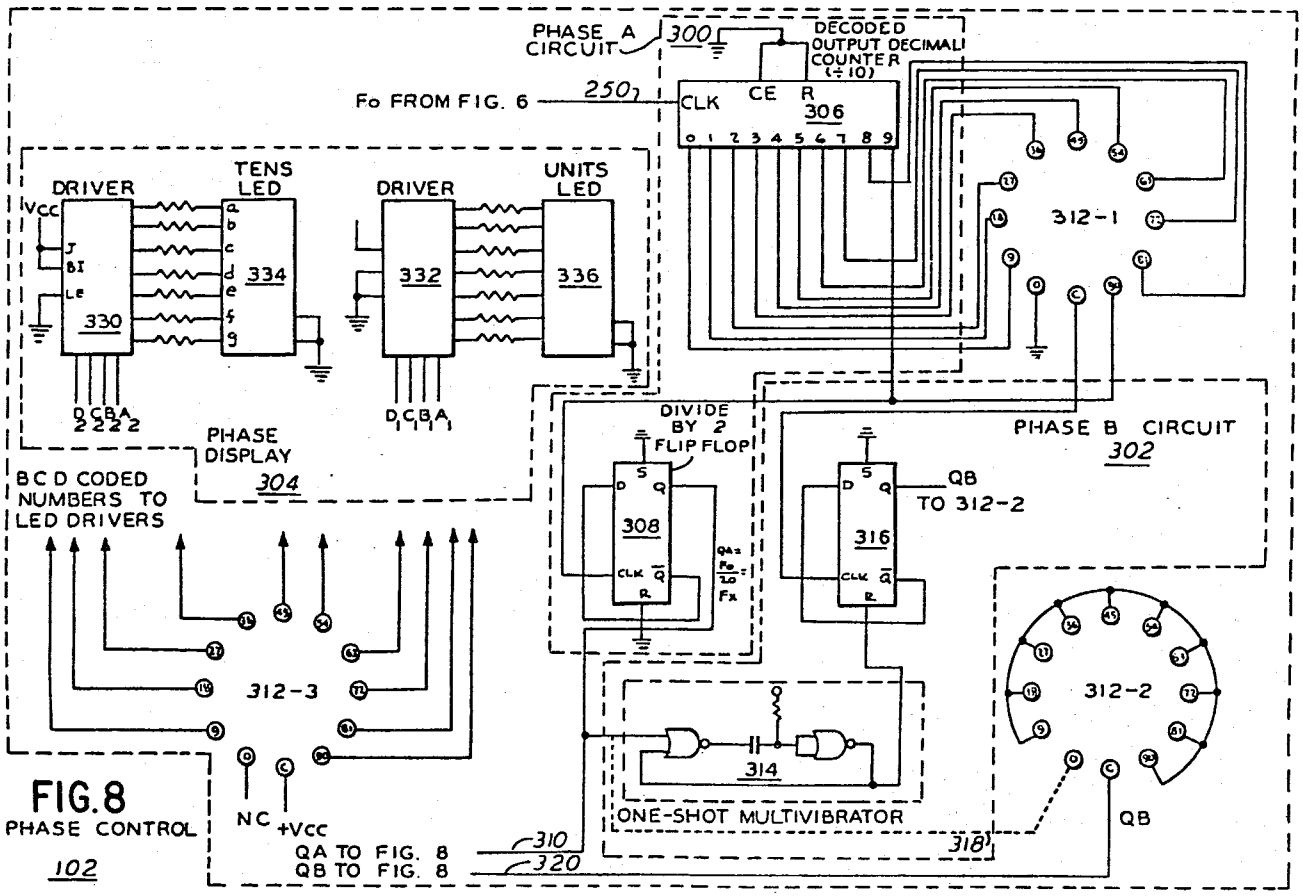
FIG. 8 is a schematic circuit diagram of the phase control portion of the processing unit of FIG. 2.

Referring now to FIG. 8, there is shown in more detail a schematic diagram of phase control unit 102. Phase control unit 102 comprises phase A circuit 300, a phase B circuit 302 and a phase display circuit 304.

Phase A circuit 300 is essentially divided by 20 counter comprising an integrated circuit decoded output decimal counter 306 (for example, a 4017 Decimal Counter) to divide the $F_O$ input from frequency selector 100 into ten, and a divide by 2 flip flop 308 (for example, a 4013 Dual D Flip Flop). Those skilled in the art will understand that the output $Q_A$ of phase A circuit 300, on line 310, is a digital series of pulses having the same frequency as that displayed on LED display 210 of FIG. 7.

Counter 306 is wired as shown in FIG. 8, its output lines 0–9 being connected respectively to contacts on rotary switch 312-1. The tenth pulse going through counter 306 (i.e. the pulse at terminal member 9) is used as a clock pulse to trigger flip flop 308, thus producing alternately high and low output pulses $Q_A$ having a frequency $F_O \div 20 = F_X$.

Switch 312-1 is one plate of an 11 position ganged switch generally designated 312, with the remaining plates thereof being designated 312-2 and 312-3 as shown. The terminals of each plate of the ganged switch 312 are designated in increments of 9° going from 0° to 90° to represent a variable phase difference between the A and B sets of signals selectable within the range 0° to 90°.

The output of counter 306 and $Q_A$ are utilized by phase B circuit 302 to produce an output signal $Q_B$ having the same frequence as $Q_A$ but of different phase. The output signal $Q_A$ goes through a one-shot multivibrator 314 which produces an output pulse to reset flip flop 316 (for example, a 4013 Dual D Flip Flop) while the output of counter 306 is selectively (by means of switch 312-1) applied to the clock input of flip flop 316. As will be understood by those skilled in the art, the result is that the output $Q_B$ of flip flop 316 is shifted in time form $Q_A$ as more clearly seen in lines 3, 4 and 5 of the timing diagram FIG. 11.

The output $Q_B$ of flip flop 316 is wired to switch 312-2 having contacts 2–11 (designated by numerals 9–90 representing degrees) thereof shorted while contact 1 is connected to $Q_A$ via line 318. Consequently, when switch 312-2 is in position 1 (marked 0°) the output of phase B circuit 302 on line 320 is $Q_A$ and both $X_Z$ and $X_B$ transducers will be oscillating in phase, i.e. phase difference=0° and the plates consequently move simultaneously in the same direction at each instant of time. A phase difference of 90° is representative of a relative movement of the two plates in opposite directions at each instant of time. The greatest effects of cavitation disruption and the maximum power transfer to the medium being processed have been observed to fall between 40° and 60°. When switch 312-2 is in any other position, its output is dictated by the output of flip flop 316 which is a function of the position of switch 312-1. Those skilled in the art will understand that the phase difference between $Q_A$ and $Q_B$ can be stepped from 0° to 90° in 9° increments.

A visual display of the phase difference between $Q_A$ and $Q_B$ is provided by phase display 304. Switch 312-3, ganged to switches 312-1 and 312-2, enables certain combinations of inputs of LED drivers 330 and 332 (each, for example, a 4511 BCD to 7 segment latch, decoder/driver), in turn causing LED chips 334 (tens) and 336 (units) to fire respectively and display that number corresponding to the pre-wired combinations necessary to reflect phase difference increments from 0° to 90° in 9° increments. The detailed wiring to effect such results is conventional and therefore not discussed herein.

The present invention utilizes phase relationships between the oscillating plates to achieve doppler and other ultrasonic effects similar to those occurring in prior art ultrasonic processors having extremely thin processing chambers. However, the present invention neither requires nor depends upon reflections of ultrasonic oscillations from surfaces opposite the oscillating source. The phase difference between the oscillating plates therefore eliminates the necessity for reflections in prior art processors and enables much larger (deeper) processing chambers. The depth of the chambers which are made possible by the present invention depends upon the power and frequency of the signals applied to the transducers—lower frequencies generally enables deeper chambers, all other parameters being equal.

The phase difference between the oscillating plates effectively produces a plurality of frequencies similar to the result obtained due to doppler effects in thin prior art ultrasonic processors. The phase difference increases the number of rarefactions and compressions set up within the medium being processed and thus tends to remove standing waves, thus improving and increasing the ultrasonic energy gradient within the processing chamber. The power or energy transferred to the processing chamber may be sensed by a conventional power meter (not shown). As stated above, the maximum power transfer appears to occur between 30° and 50° phase difference. This power transfer may be further enhanced by operation under increased atmospheric pressure.

The outputs $Q_A$ and $Q_B$, each a digital series of pulses having a frequency$=F_X$, are applied to power control unit 104, (more specifically shown in FIG. 6) which effects power control of the pulses applied to the transducers through pulse width modulation. Unit 104 is divided into two identical sections: $X_A$ transducer power section 402 and $X_B$ transducer power circuit 404. In view of the identity between section 402 and 404, only the former will be described in detail herein. However, it will be understood that the circuits disclosed herein may, if desired, be employed to vary the duty cycle of each signal transducer in an ultrasonic processor.

Section 402 comprises counter 406 (for example, a 4017 Decimal Counter) which receives an $F_O$ clock input at its clock terminal from line 250 via line 408. Counter 406 also receives at its clock enable terminal the QA output of phase control unit 02 through an inverter 410. The $Q_A$ signal is also provided to one-shot multivibrator 412, the output of which sets flip flop 414 (for example, a 4013 Dual D Flip Flop) when $Q_A$ goes high. The decoded outputs of counter 406 occur at each of the ten pulses after the clock enable pulse and go through an 11 position rotary switch 416-1 (not shown), through inverter 418 and multivibrator 420, the output of which is provided to the reset terminal of flip flop 414. Switch 416-2 (not shown), ganged to switch 416-1, receives the Q output of flip flop 414 and connects it in parallel to buffer amplifiers 410, 422, 424 and 426 which ultimately, as will be shown below, provide power control signal for $X_A$ transducers 30, 32, 34 and 36 respectively.

The clock input frequency to counter 406 is $F_O=20$ $F_X$ and thus each time $Q_A$ goes high at the clock enable terminal of counter 406, the ten outputs of the counter will range in 5% increments from 5% (at the output terminal marked 10) to 50% (at the output terminal marked 100). The numbers applied to the output terminals being arbitrary and merely indicative of "full-scale"(50%) duty cycle being equal to 100.

When $Q_A$ goes high it triggers a one-shot multivibrator 412 which sets flip flop 414 causing its Q output to go high.

The Q output is made low when flip flop 414 is reset by one-shot 420 which fires in response to a selected output of counter 406. Thus the Q output of flip flop 414 may have a duration from zero to whatever duration $Q_A$ has (which in the preferred embodiment is a 50% duty cycle since $Q_A$ remains high for 10 clock pulses and low for 10 clock pulses).

Those skilled in the art will understand that the circuit of section 402 provides output signals (to the transducers on lines 430, 432, 434 and 436) which have selectively variable duty cycles depending upon the position marked 10 the reset signal is applied to flip flop 414 on the first clock pulse after the clock enable pulse. The output of line 430 (connected to $X_A$ transducer 30) in relationship to the output of corresponding line 440 (connected to one of the $X_B$ transducers) is shown more clearly on lines 6 and 7 of timing diagram FIG. 11. These output signals are represented as having a 60% duty cycle.

The preferred embodiment of the invention utilizes means for enabling the apparatus disclosed herein to have different duty cycles applied to the oscillating plates. Thus plate 48 transducers may be excited by a 50% duty cycle while plate 72 transducers may simultaneously be excited by a 30% duty cycle. The advantages offered by such flexibility are significant. It has been found, for example, that the more difference in duty cycles applied to plates 48 and 72 (all other parameters being the same can produce different effects upon the material in the processing chamber. Thus, one set of duty cycles (e.g. 50% on plate 48 and 30% on plate 72) may produce a stable emulsion (if the apparatus is used for emulsification) while a different set of duty cycles may produce an unstable emulsion.

Referring now to FIG. 7 showing a power driver circuit 500, the further processing of the output signal on line 430 is explained.

Power driver circuit 500 is one of several identical power driver circuits in power driver unit 106 shown in FIG. 2. Each transducer utlized in the preferred embodiment has one such power driver circuit 500 associated therewith. For clarity, therefore, only one such circuit is shown in FIG. 12 and is more specifically described herein.

The output of line 430 of FIG. 9 is associated with the number of transducer 30 in the A section 16. The signal on line 430, more clearly seen on line 6 of timing diagram FIG. 12 is amplified in the circuit shown in FIG. 10 to provide pulse power to transducer winding 60 through leads 64 and 66 at a frequency equal to that shown on frequency display 210. The pulsing of the transducers enables a greater power input because of the absence of a temperature rise in the transducers and because of the short drive time. Any requisite cooling of the transducers is also effected by the slurry or medium being processed.

FIG. 7 shows a cascaded transistor array comprising transistor 502, 504 and 505 which turn on high speed output drive transistor 506 when the output signal on line 430 is low. The result is that the associated transducer is excited by a signal shown in FIG. 11 on lines 8 and 9 and designated as the "A" and "B" drive signals for driving the A and B transducers respectively.

Transistor 508 functions as a current clamp to limit the maximum current in the transducer windings to prevent saturation. Capacitor 510 is placed across each transducer to improve the power factor. Each output transistor 506 has associated therewith a "snubber" network comprising capacitor 512, diode 514 and resistor 516 to extend the safe operating area of transistor 506.

Those skilled in the art will understand that there is a relationship between the power input to the $X_A$ and $X_B$ transducers and the amplitude of oscillation of each plate 48 and 72. This relationship need not be linear in order to achieve proper operation of the preferred embodiment disclosed herein.

Furthermore, the optional power transfer from the plates to the material in the processing chamber is affected by the impedance of the material, which impedance varies as a function of flow rate, particulate size, pressure, etc. Power meters (not shown) secured to plates 48 and 72 enable optimization of this power transfer even in a dynamic situation as material is flowing in the chamber. A microprocessor may be employed as a feedback controller to vary the different parameters of the invention in order to continuously maintain optimum power transfer to the material.

What is claimed is:

1. Apparatus for manufacturing a coal-oil-water mixture for use as a fuel comprising (a) a grinder for grinding coal to a relatively fine particle size;

(b) mixing means for controllably mixing said coal particles with water and oil; and (c) a sonic agitator to stabilize the coal-oil-water mixture;

the sonic agitator comprising:

(i) a processing chamber for said coal-oil-water mixture to be treated therein;

(ii) two opposed plates in contact with said mixture in said chamber, said plates being for oscillation at a predetermined frequency and said plates being disposed substantially parallel to each other;

(iii) means functionally connected to each of said opposed plates for causing each of said opposed plates to oscillate at said predetermined frequency;

(iv) means functionally connected to each of said opposed plates for causing each of said opposed plates to oscillate in a predetermined relative phase relationship; and (v) means functionally connected to each of said opposed plates for causing each of said opposed plates to oscillate at a predetermined amplitude.

2. The apparatus of claim 1 wherein said grinder is capable of grinding said coal to an average particle size of less than 100 microns, said high molecular weight organic compound is contained in a heavy residual oil containing paraffinic fractions and said sonic agitator operates at less than 20,000 cycles per second.

3. The apparatus of claim 2 including a cleaner for cleaning said coal before or after grinding.

4. The apparatus of claim 3 wherein said cleaner comprises froth flotation apparatus.

5. The apparatus of claim 3 wherein said cleaner is a sonic agitator.

6. The apparatus of claim 3 wherein said cleaner is a heavy media separator.

7. The apparatus of claim 1 further comprising means for assisting in the formation of coal-oil-water agglomerates and the removal of ash and excess water prior to stabilization of the mixture by the sonic agitator.

8. The apparatus of claim 7 wherein said assisting means includes (a) a high shear mixer to assist in the formation of said agglomerates; and (b) a first screen for removing some of said ash and excess water.

9. The apparatus of claim 8 wherein said assisting means further includes (c) a low shear mixer to assist in the formation of said agglomerates; and (d) a second screen for removing some of said ash and excess water.

10. The apparatus of claim 9 wherein said assisting means further includes (e) a first surge tank for mixing said agglomerates from said first screen with a high molecular weight organic compound; and (f) a second surge tank for mixing said agglomerates from said second screen.

11. The apparatus of claim 10 wherein said assisting means further includes (g) a ribbon mixer for mixing said agglomerates from said second surge tank with a high molecular weight organic compound; and (h) a pump to direct said agglomerates to said sonic agitator.

12. Apparatus according to any of claims 1–11 wherein said opposed plates form two surfaces of said processing chamber.

13. Apparatus for manufacturing a coal-oil-water mixture for use as a fuel comprising (a) a grinder for grinding coal to a relatively fine particle size;

(b) mixing means for controllably mixing said coal particles with water and oil; and (c) a sonic agitator to stabilize the coal-oil-water mixture;

the sonic agitator comprising:

(i) a first and second parallel plate having the front surfaces thereof facing each other and spaced at a predetermined distance for forming two sides of a processing chamber;

(ii) a spacer interposed between said parallel plates for forming the other, peripheral sides of said processing chamber, said spacer having an input aperture for enabling said fuel mixture to flow into said processing chamber and an outlet aperture for enabling said fuel mixture to flow out of said processing chamber;

(iii) at least one first transducer secured to the back surface of said first plate and for producing oscillations thereof;

(iv) at least one second transducer secured to the back surface of said second plate and for producing oscillations thereof;

(v) means functionally connected to and for causing each of said first and second transducers to oscillate at a predetermined frequency;

(vi) means functionally connected to said first and second transducers and for causing said first transducer to oscillate in a predetermined relative phase relationship to said second transducer; and (vii) means functionally connected to and for causing each of said first and second transducers to oscillate at a predetermined amplitude;

whereupon, upon causing said fuel mixture to flow through said processing chamber while causing said first and second transducers to oscillate at said predetermined phase, amplitude and frequency, said plates will oscillate thereby creating oscillations within said fuel mixture in said processing chamber thereby treating said fuel mixture.

14. Apparatus according to claim 13 wherein said input and outlet apertures are substantially linearly aligned.

15. Apparatus according to claim 14 wherein said plates are symmetrically disposed about the alignment axis of said input and outlet apertures.

16. Apparatus according to claim 15 wherein said predetermined amplitude of oscillation of each of said plates is selectable within a predetermined range of amplitudes while said fuel mixture is flowing through said processing chamber.

17. Apparatus according to claim 15 wherein said predetermined relative phase relationship between the oscillations of each of said plates is selectable within a predetermined range of relative phase relationships while said fuel mixture is flowing through said processing chamber.

18. Apparatus according to claim 15 wherein said predetermined frequency of oscillations of each of said plates is selectable within a predetermined range of frequencies while said material is flowing through said processing chamber.

19. Apparatus for manufacturing a coal-oil-water mixture for use as a fuel comprising (a) a grinder for grinding coal to a relatively fine particle size;

(b) mixing means for controllably mixing said coal particles with water and oil; and (c) a sonic agitator to stabilize the coal-oil-water mixture;

the sonic agitator comprising:

(i) a processing chamber having an input thereto and an outlet therefrom for said fuel mixture to flow therethrough and to be treated therein;

(ii) two opposed rectilinear plates in contact with said fuel mixture in said chamber, said plates being for oscillation and said plates being disposed substantially parallel to each other, said plates forming two surfaces of said processing chamber and the front surfaces of said plates facing each other;

(iii) a first plurality of magnetostrictive transducers having their radiating surfaces secured to the backs of one of said opposed plates;

(iv) a second plurality of magnetostrictive transducers having their radiating surfaces secured to the backs of the other of said plates;

(v) oscillating means for producing first signals having a frequency selectable within a predetermined range of frequencies;

(vi) phase means functionally interconnected with said oscillating means and responsive to the frequency output thereof for producing at least two first output signals having selectable phase relationships therebetween;

(vii) power signal means functionally interconnected with said oscillating means, and responsive to the frequency output thereof, and functionally interconnected with said phase means, and responsive to said first output signals thereof, for producing a first and second set of power signals, said first set of power signals corresponding to one of said first output signals and said second set of power signals corresponding to the other of said first output signals, said first set of power signals corresponding in number to said first plurality of transducers and said second set of power signals corresponding in number to said second plurality of transducers, each one of said first set of power signals corresponding respectively to one of said first plurality of transducers, each one of said second set of power signals corresponding respectively to one of said second plurality of transducers, said power signal means for controlling the magnitude of power within said first and second sets of power signals;

(viii) a first set of driving means corresponding in number to said first plurality of transducers and functionally interconnected with said first set of power signals and said first plurality of transducers, each of said first set of driving means respectively responsive to said first set of power signals for driving respectively said first plurality of transducers; and (ix) a second set of driving means corresponding in number to said second plurality of transducers and functionally interconnected with said second set of power signals and said second plurality of transducers, each of said second set of driving means respectively responsive to said second set of power signals for driving respectively said second plurality of transducers.

20. Apparatus according to any of claims 1 to 19 wherein said flowing material may be processed in said processing chamber at a selectable predetermined pressure other than atmospheric pressure.

21. Apparatus according to claim 19 wherein said input and outlet are substantially linearly aligned.

22. Apparatus according to claim 19 wherein said power signal means includes means for selecting the duty cycle of said first set of power signals within a predetermined range of duty cycles and for selecting the duty cycle of said second set of power signals within said predetermined range of duty cycles.

23. Apparatus for manufacturing a coal-oil-water mixture for use as a fuel comprising (a) a grinder for grinding coal to a relatively fine particle size;

(b) mixing means for controllably mixing said coal particles with water and oil; and (c) a sonic agitator to stabilize the coal-oil-water mixture;

the sonic agitator comprising:

(i) a plurality of serially connected processing chambers, each one having an input thereto and an outlet therefrom for said fuel mixture to flow therethrough and to be treated therein, the output of one processing chamber connected to the input of the next successive processing chamber;

(ii) a plurality of sets of two opposed, substantially parallel plates, said plurality of sets being equal in number to said plurality of processing chambers, each set being within one respective processing chamber, each of said opposed plates being in contact with said fuel mixture within their respectively associated processing chambers, said opposed plates within each of said sets for being vibrated at a predetermined frequency;

(iii) means functionally connected to each of said opposed plates for causing each of said plates within each of said sets to oscillate at said predetermined frequency;

(iv) phase means functionally connected to each of said opposed plates for causing one of said plates within each of said sets to oscillate in a predetermined phase relationship relative to the other corresponding plate within each of said sets; and (v) means functionally connected to each of said opposed plates for causing each of said plates to oscillate at a predetermined amplitude of oscillation.

24. Apparatus according to claim 23 wherein said frequency means comprises:

means for causing each plate of each of said sets of plates to oscillate at a frequency which varies among said sets and from one of said sets to the next successive one of said sets for producing a gradient of frequencies among said plurality of sets of plates.

25. Apparatus according to claim 24 wherein said phase means comprises:

means for causing one of said plates of each of said sets of plates to oscillate at a phase relative to the other corresponding plate of each of said sets such that the phase difference between the plates of one of said sets varies from the phase difference between the plates of the next successive one of said sets for producing a gradient of phase differences among said plurality of sets of plates.

26. Apparatus according to claim 25 wherein said amplitude means comprises:

means for causing each plate of each of said sets of plates to oscillate with an amplitude of oscillation which varies among said sets and from one of said sets to the next successive one of said sets for producing a gradient of amplitudes of oscillation among said plurality of sets of plates.

27. Apparatus as defined in claim 8, wherein the sonic agitator comprises:

a processing chamber for said fuel mixture to be treated therein;

two opposed plates in contact with said fuel mixture in said chamber, said plates being for oscillation at a predetermined frequency and said plates being disposed substantially parallel to each other;

means functionally connected to each of said opposed plates for causing each of said opposed plates to oscillate at said predetermined frequency;

means functionally connected to each of said opposed plates for causing each of said opposed plates to oscillate in a predetermined relative phase relationship; and means functionally connected to each of said opposed plates for causing each of said opposed plates to oscillate at a predetermined amplitude.

28. Apparatus according to any of claims 13 to 27 wherein said opposed plates form two surfaces of said processing chamber.

29. The apparatus of any of claims 13 to 28 further comprising means for assisting in the formation of coal-oil-water agglomerates and the removal of ash and excess water prior to stabilization of the mixture by the sonic agitator.

30. The apparatus of claim 29 wherein said assisting means includes (a) a high shear mixer to assist in the formation of said agglomerates; and (b) a first screen for removing some of said ash and excess water.

31. The apparatus of claim 30 wherein said assisting means further includes (c) a low shear mixer to assist in the formation of said agglomerates; and (d) a second screen for removing some of said ash and excess water.

32. The apparatus of claim 31 wherein said assisting means further includes (e) a first surge tank for mixing said agglomerates from said first screen with a high molecular weight organic compound; and (f) a second surge tank for mixing said agglomerates from said second screen.

33. The apparatus of claim 32 wherein said assisting means further includes (g) a ribbon mixer for mixing said agglomerates from said second surge tank with a high molecular weight organic compound; and (h) a pump to direct said agglomerates to said sonic agitator.

34. Apparatus as defined in any of claims 1–33 wherein the spacing between the plates is of the order of 500 meters per second divided by the applied sonic frequency, and is at least 25 mm.

* * * * *